US008096226B1

(12) United States Patent
Cook

(10) Patent No.: US 8,096,226 B1
(45) Date of Patent: Jan. 17, 2012

(54) ASSAULT VEHICLE

(76) Inventor: Kendrick Cook, Lutz, FL (US)

( * ) Notice: Subject to any disclaimer, the term of this patent is extended or adjusted under 35 U.S.C. 154(b) by 600 days.

(21) Appl. No.: 12/231,035

(22) Filed: Aug. 28, 2008

(51) Int. Cl.
*F41A 27/18* (2006.01)

(52) U.S. Cl. ..... 89/37.13; 89/36.08; 89/37.12

(58) Field of Classification Search ..... 89/36.08, 89/37.12, 37.13
See application file for complete search history.

(56) References Cited

U.S. PATENT DOCUMENTS 2,388,873 A * 11/1945 Schwab ..... 89/36.13
3,644,456 A * 2/1972 Smith, Sr. et al. ..... 560/334
3,916,632 A * 11/1975 Thomas ..... 405/196
4,282,794 A 8/1981 Miller et al.
4,386,848 A 6/1983 Clendenin et al.
4,742,390 A 5/1988 Francke et al.
4,993,912 A 2/1991 King et al.
5,129,308 A 7/1992 Fuereder et al.
6,711,980 B2 3/2004 Kropf
7,077,049 B2 7/2006 Shumov et al.

* cited by examiner

*Primary Examiner* — Stephen M Johnson
(74) *Attorney, Agent, or Firm* — Edward P Dutkiewicz, P.A.

(57) ABSTRACT

An assault vehicle, comprising, in combination a vehicle body and a boom. The boom comprises a plurality of telescoping tubes being coupled to the vehicle body. The vehicle boom has a passageway there in. At the upwardmost end of the boom is located the fighting pod. The fighting pod has a boom elevator aperture there through to allow passage of a soldier from the vehicle, through the boom, and into the fighting pod. An elevator within the boom moves supplies and troops.

15 Claims, 10 Drawing Sheets

FIG. 1
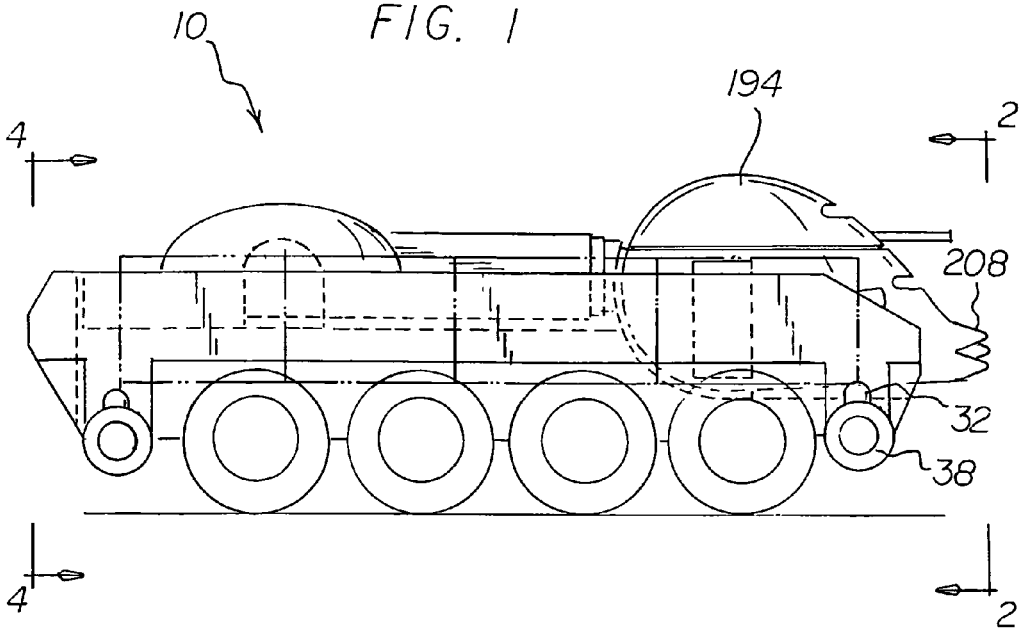
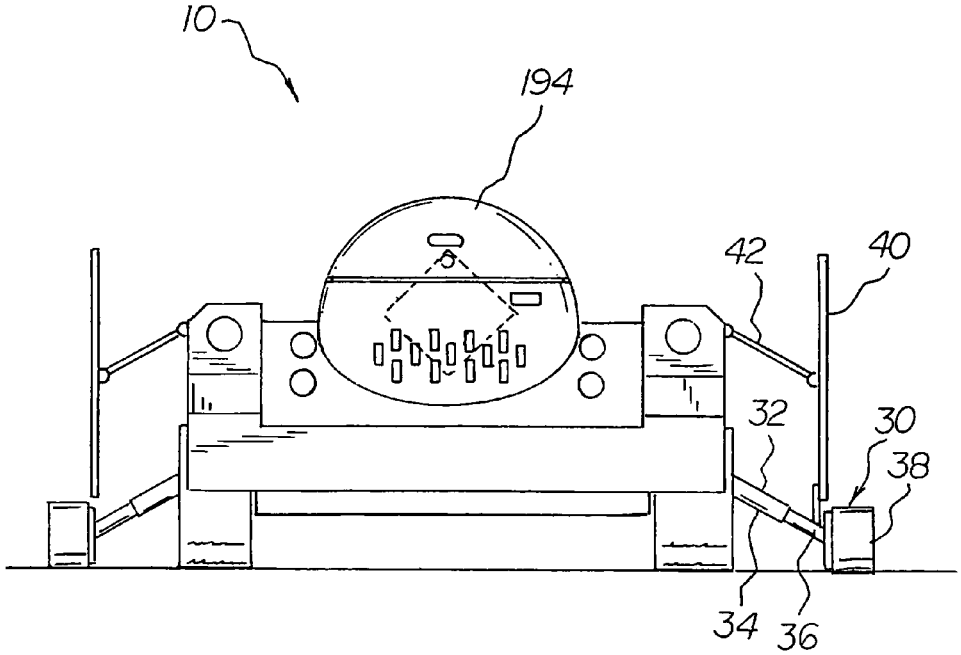
FIG. 2

FIG 4
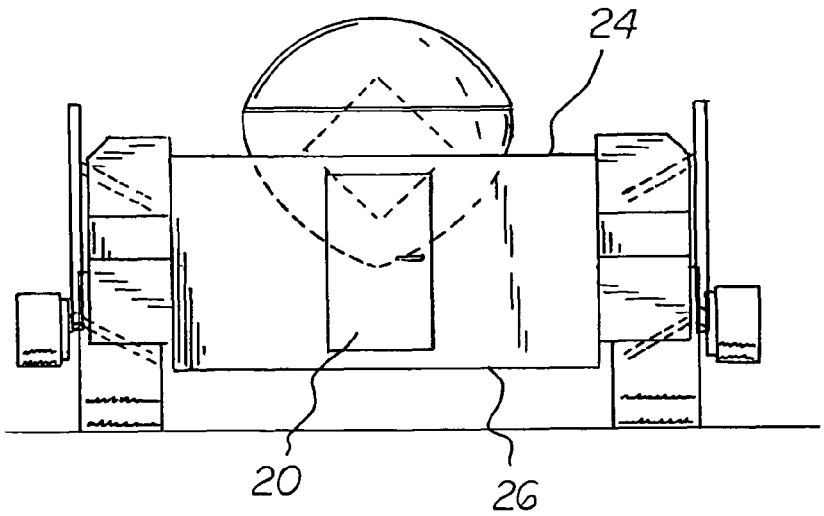
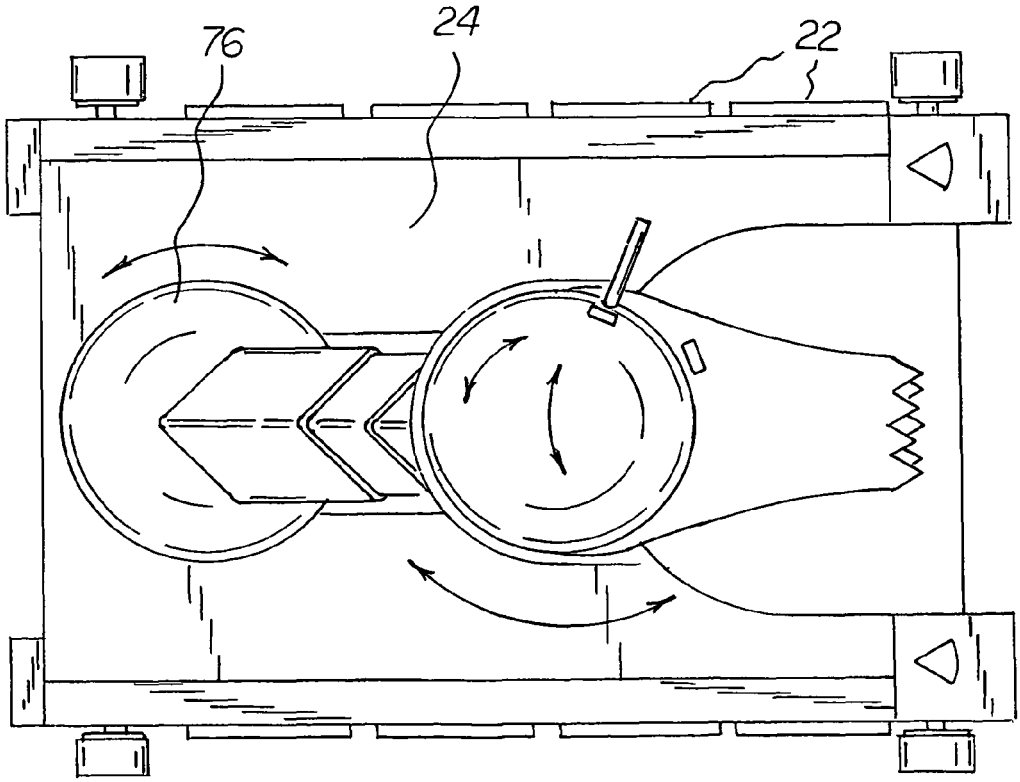
FIG 5

FIG 12
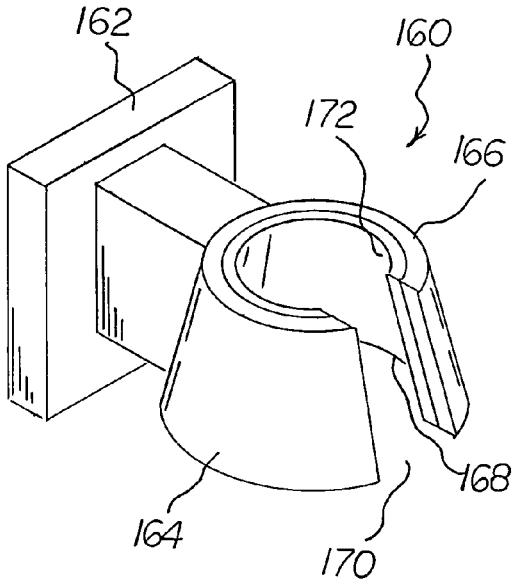
FIG 13
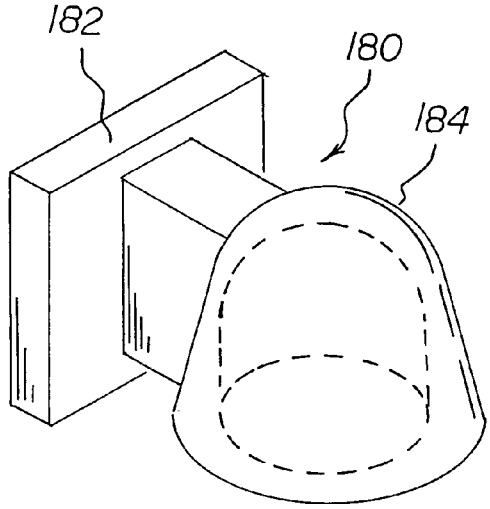
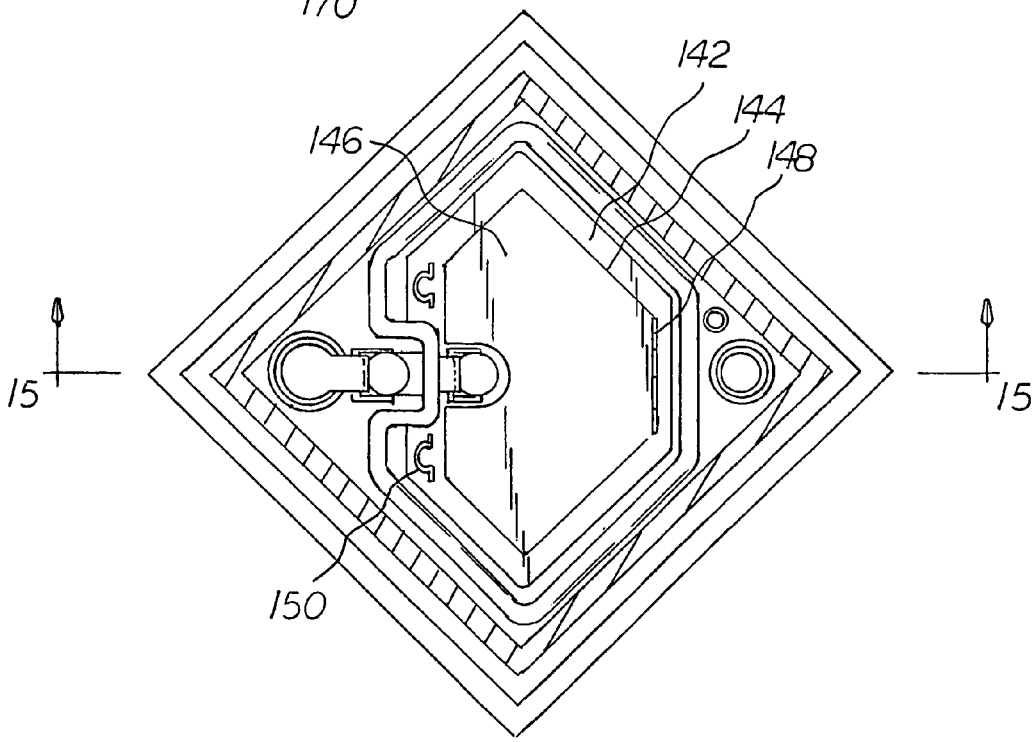
FIG 14

FIG 15
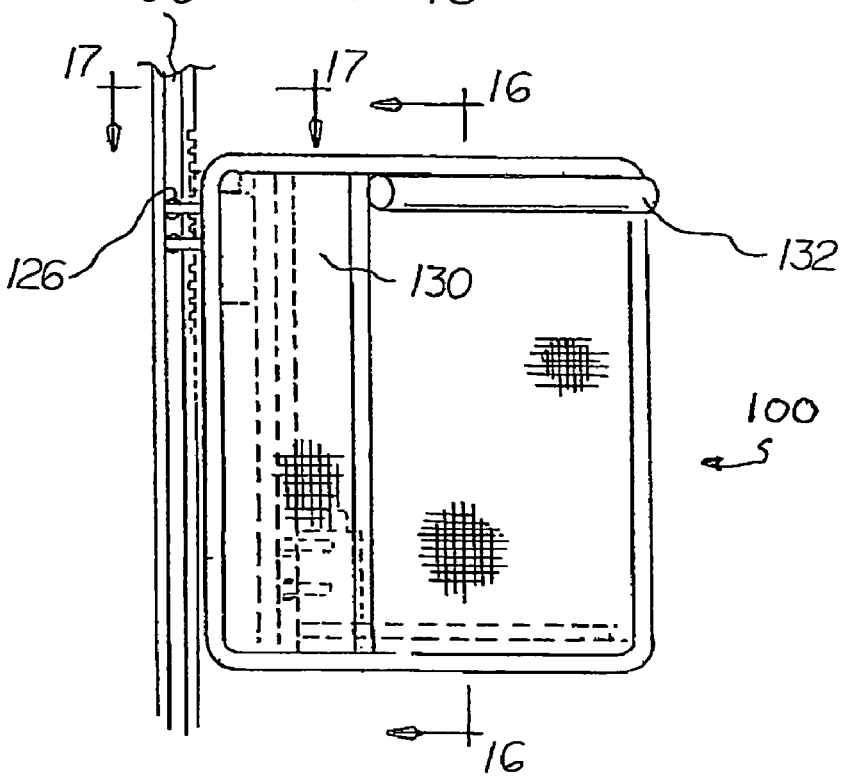
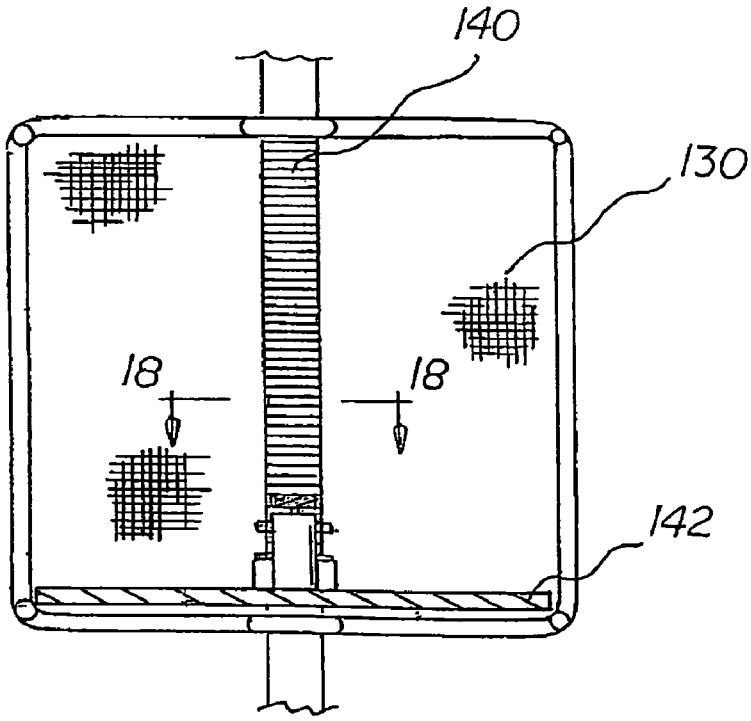
FIG 16

ASSAULT VEHICLE

NEW RULE 1.78 (F) (1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to an assault vehicle and more particularly pertains to a way of assaulting elevated positions as found in the urban environment.

2. Description of the Prior Art

The use of assault machines is known in the prior art. More specifically, assault machines previously devised and utilized for the purpose of assaulting elevated or fortified positions are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe an assault vehicle that allows a way of assaulting elevated positions as found in the urban environment.

In this respect, the an assault vehicle according to the present invention substantially departs from the conventional concepts and designs of the prior art, and in doing so provides an apparatus primarily developed for the purpose of a way of assaulting elevated positions as found in the urban environment.

Therefore, it can be appreciated that there exists a continuing need for a new and improved an assault vehicle which can be used for assaulting elevated positions as found in the urban environment. In this regard, the present invention substantially fulfills this need.

SUMMARY OF THE INVENTION

In view of the foregoing disadvantages inherent in the known types of assault machines now present in the prior art, the present invention provides an improved assault vehicle. As such, the general purpose of the present invention, which will be described subsequently in greater detail, is to provide a new and improved assault vehicle and method which has all the advantages of the prior art and none of the disadvantages.

To attain this, the present invention essentially comprises an assault vehicle comprising several components, in combination.

First provided is a vehicle body. The vehicle body has an outer surface and an inner surface, with a thickness there between. The vehicle body has a top surface and a bottom surface, with side surfaces coupling the top surface and bottom surface. The inner surface of the vehicle body forms an interior cavity. The vehicle body interior cavity has a driving compartment, an engine compartment, and a payload compartment. The payload compartment has an upwardly directed boom aperture therein.

The vehicle body has a plurality of associated ground bearing subassemblies. The ground bearing subassemblies each have a plurality of associated stabilizing outriggers. Each outrigger has a deployed position and a non-deployed position. Each outrigger has a vehicle attachment end and a surface bearing end. The surface bearing end of each of the outriggers has a contact wheel associated there with. The deployed position of each of the outriggers comprises the contact wheel of the outrigger bearing end being in contact with a recipient surface. The non-deployed position comprises the outrigger bearing end being free of a recipient surface.

Next provided is a vehicle boom. The vehicle boom comprises several components, in combination.

There is provided a first telescoping tube, a second telescoping tube, and a third telescoping tube. The first telescoping tube has a generally square cross sectional configuration. The first telescoping tube has an exterior surface having a first external dimension, and an interior surface with a first interior dimension. There is formed a wall thickness there between.

The second telescoping tube has a generally square cross sectional configuration. The second telescoping tube has an exterior surface, having a second external dimension and an interior surface with a second interior dimension. There is formed a wall thickness there between. The second exterior dimension is less than the first interior dimension so as to allow the second telescoping tube to be slidably located within the interior of the first telescoping tube.

The third telescoping tube has a generally square cross sectional configuration. The third telescoping tube has an exterior surface having a third external dimension and an interior surface with a third interior dimension. There is formed a wall thickness there between. The third exterior dimension is less than the second interior dimension so as to allow the third telescoping tube to be slidably located within the interior of the second telescoping tubes. The third telescoping tube has a chase therein for carrying conduit there through.

A boom mounting bracket is used to pivotably mounting the boom to the top surface of the vehicle body at an area of attachment. The boom mounting bracket has an upper component and a lower component. The upper and lower components are slidable coupled and have an associated hydraulic cylinder. The hydraulic cylinder has a base and a movable ram. The base of the cylinder is coupled to the lower component of the boom mounting bracket. The ram of the hydraulic cylinder is coupled to the upper component of the boom mounting bracket. This configuration allows the boom mounting bracket to have an upwardly extended deployment configuration, and a retracted non-deployed configuration.

The boom mounting bracket has a protective skirt overlying the area of attachment to the vehicle body top surface around the lower portion of the boom mounting bracket.

The boom has a hydraulic extending system comprising at least one hydraulic cylinder for slidably extending and retracting the boom telescoping tubes. As with all hydraulic systems, there is a power source, such as an internal combustion engine, coupled to a hydraulic pump and pump reservoir. Within the reservoir is contained the hydraulic fluid, which is used to actuate the hydraulic cylinders to extend or retract. Valve, used to direct the fluid bring about the actuation of the hydraulic cylinders.

There is an internal boom elevator located within the boom. The boom elevator is coupled to the boom mounting bracket. The internal boom elevator has an uppermost deployment and a lowermost deployment (or non-deployment) and an area of transition there between. The internal boom elevator comprises several components, in combination.

The first component of the boom elevator is a hydraulic cylinder with a slidably movable ram. The hydraulic cylinder is coupled to the boom mounting bracket. The ram of the hydraulic cylinder has an associated end track coupled thereto.

The next component of the boom elevator is an elevator cage gear rack. The elevator cage gear rack is coupled to the end track of the hydraulic cylinder.

The next component of the boom elevator is an elevator cage. The elevator cage is coupled to the elevator cage gear rack. There is an associated first electric motor and first worm gear coupled to the elevator cage. The first electric motor and first worm gear are mounted and configured to engage the elevator cage gear rack, so as to allow the cage to ride up and down the end track of the ram.

The elevator cage has a plurality of sides, with an overlying mesh. The sides each have a lower extent and an upper extent. The sides are coupled together so as to form a generally rectangular tubular configuration, thereby forming a cage located within the telescoping boom. The cage has one of the sides of the cage comprising a door, to allow entry and exit to and from the cage when the cage is in the lowermost, non-deployment, position.

The cage has a movable floor. The floor has an upper surface, a bottom surface, and a thickness there between. The thickness of the floor comprises a side edge. The floor has an escape panel aperture therein.

The cage floor has a second associated electric motor having a second worm gear. The cage floor electric motor worm gear is coupled to the cage floor, and engaged in the elevator floor rack which is coupled to the cage side. This configuration allows the cage floor to ride up and down within the interior of the elevator cage. The floor gear rack runs from the lowermost extent of the cage side to the uppermost extent of the cage side.

The floor has an associated escape panel. The escape panel has an upper surface, a bottom surface, and a thickness there between. The thickness comprises a side edge of the escape panel. The escape panel has a closed position and an open position. The floor escape panel has an associated hinge which couples the side edge of the floor escape panel with the floor escape aperture. The floor escape panel has a securement catch to maintain the escape panel in a closed position. The escape panel open position allows for entry and exit to and from the cage through the floor escape aperture when the cage is out of the non-deployed position. The floor has a latching ring for the attachment of an emergency descent rope.

The next component of the boom elevator is a ram guiding sleeve, also known as a "sleeve guide". The ram guiding sleeve has a mounting plate and a guide. The guide has a top extent with a top internal dimension and external dimension, and a bottom extent with a bottom internal dimension and external dimension. The guide sleeve has a generally C-shaped configuration, with an outer surface and an inner surface. The inner surface of the guide comprises a general taper along the inner surface length. The taper runs from guide sleeve bottom to guide sleeve top. The bottom internal dimension of the guide is larger than the top internal dimension of the guide, thereby forming the taper. The C-shaped configuration of the guide defines a slot in the guide sleeve, with the slot running from the bottom extent of the guide sleeve to the top extent of the guide sleeve. The slot allows the passage there through of the ram end track.

The last component of the boom elevator is a ram receiving cup. The ram receiving cup has a mounting plate and a cup portion. The cup portion has a generally hemispherical configuration, with a downwardly convex external surface and a downwardly concave internal surface, forming an inverted cup.

The final component of the assault vehicle is a fighting pod. The fighting pod has a lower portion, an upper portion and a ramming portion. The lower portion has a generally rounded configuration with a lowermost extent. The lowermost extent has a location for the coupling of the fighting pod to the third telescoping tube of the boom. The fighting pod has a protective skirt associated with the place of joining of the pod to the boom.

The lowermost extent of the fighting pod further comprises a boom elevator aperture, having an associated door. The lowermost extent comprises a coupling location for coupling the fighting pod to the boom. The fighting pod also has at least one weapons mounting location, as well as at least one viewing port. The upper portion of the fighting pod comprises a rotatably mounted turret having a mounted weapon. The ramming portion is forward of the lower portion and has a generally tapered forwardmost end, with a plurality of ripping teeth thereon.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved assault vehicle which has all of the advantages of the prior art assault machines and none of the disadvantages.

It is another object of the present invention to provide a new and improved assault vehicle which may be easily and efficiently manufactured and marketed.

It is further object of the present invention to provide a new and improved assault vehicle which is of durable and reliable constructions.

An even further object of the present invention is to provide a new and improved assault vehicle which is susceptible of a low cost of manufacture with regard to both materials and labor, and which accordingly is then susceptible of low prices of sale to the military and police users, thereby making such an assault vehicle economically available.

Even still another object of the present invention is to provide an assault vehicle for assaulting elevated positions, as found in the urban environment.

Lastly, it is an object of the present invention to provide a new and improved An assault vehicle, comprising, in combination a vehicle body and a boom. The boom comprises a plurality of telescoping tubes being coupled to the vehicle body. The vehicle boom has a passageway there in. At the upwardmost end of the boom is located the fighting pod. The fighting pod has a boom elevator aperture there through to allow passage of a soldier from the vehicle, through the boom, and into the fighting pod. An elevator within the boom moves supplies and troops.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the vehicle, with boom lowered, and end unit in travel position.

FIG. 2 is a view taken along line 2-2 of FIG. 1. Note the grating which is in a parallelogram configuration, and coupled to the outrigger and the vehicle. Note that as the outrigger is raised, the grating raises, but remains parallel to the side of the vehicle. If there is already existing grating on the side of the vehicle, the grating will be positioned to be a second layer of grating long the side of the vehicle.

FIG. 4 is a rear elevational view of the vehicle, with the boom lowered. Note the rear doorway, for ingress and egress to the interior compartment within the vehicle.

FIG. 5 is a top plan view of the vehicle, with boom at least partially extended. Note the turret may rotate to engage enemy in a 360 degree position relative to the end unit.

In FIG. 10, the elevator is being deployed. Note that the elevator ram has not, as yet, passed through the slotted guide.

FIG. 12 is a perspective view of the slotted guide. Note the tapered plastic insert. The taper may be in the range of five to thirty degrees.

FIG. 13 is a perspective view of the receiving cup. Note the inverted hemispherical hollow recess, shown in phantom.

FIG. 14 is a view taken along line 14-14 of FIG. 11.

FIG. 15 is a view taken along line 15-15 of FIG. 14.

FIG. 16 is a view taken along line 16-16 of FIG. 15.

The same reference numerals refer to the same parts throughout the various Figures.

DESCRIPTION OF THE PREFERRED EMBODIMENT

Figure 3:
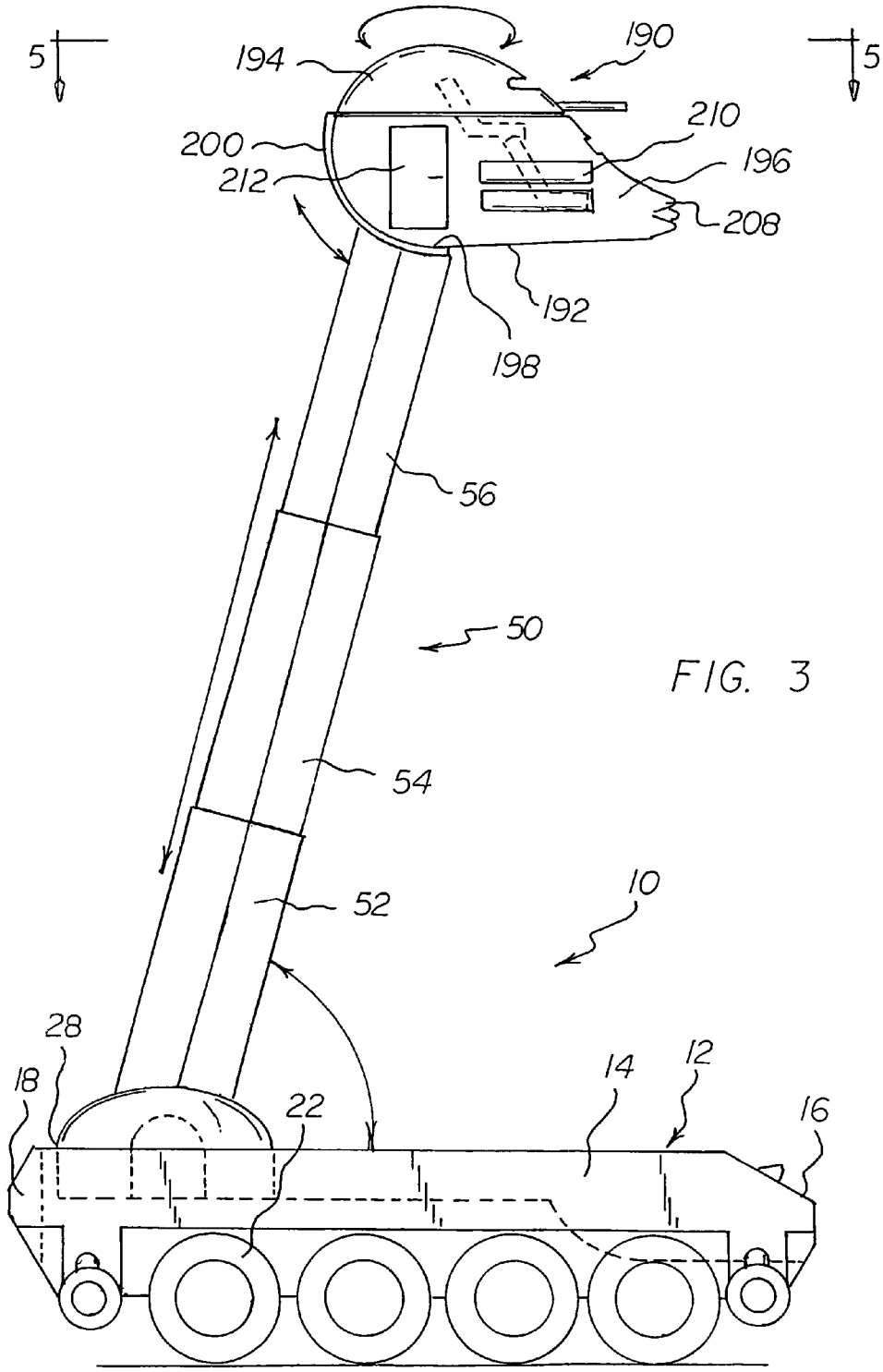
FIG. 3 is a view of the vehicle with boom up, and in the attack configuration. Note that the stabilizers are in non-deployed position.
Figure 6:
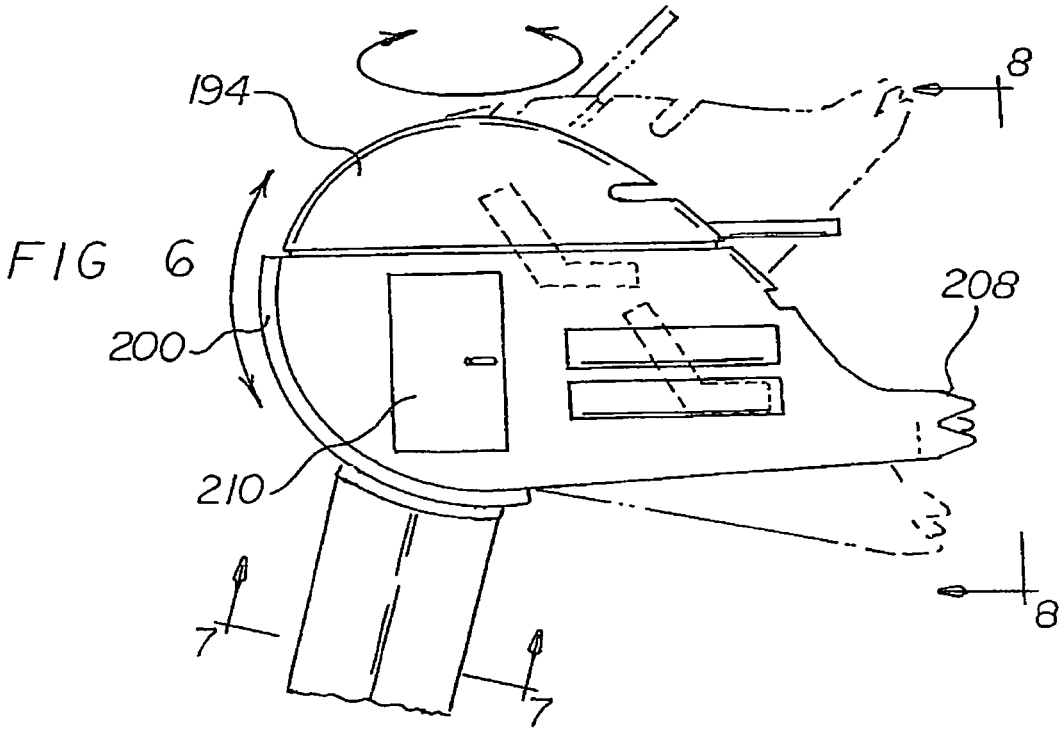
FIG. 6 is a side elevational view of the fighting pod. Note the forward and rearward pivoting of the pod.
Figure 7:
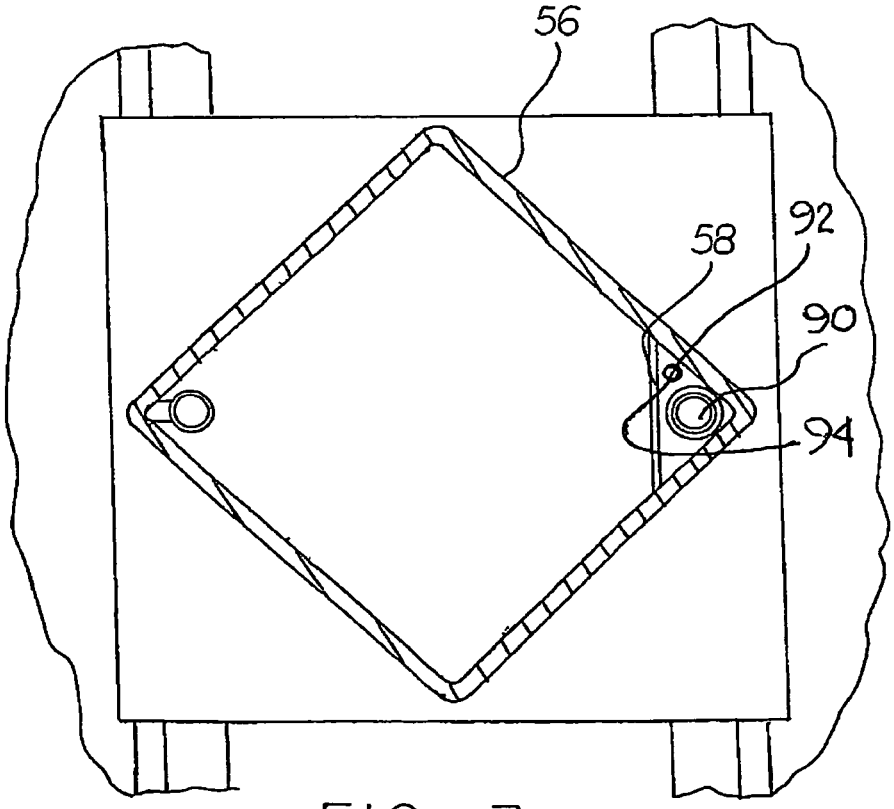
FIG. 7 is a cross section of the boom, taken along line 7-7 of FIG. 6. Note the elevator hydraulic shaft and the extending hydraulic shaft, which is within the chase of the uppermost tube of the boom. There is located a telescoping wire guide with a wrapped wire near the extending hydraulic shaft, for providing power to the upper extent of the boom.
Figure 8:
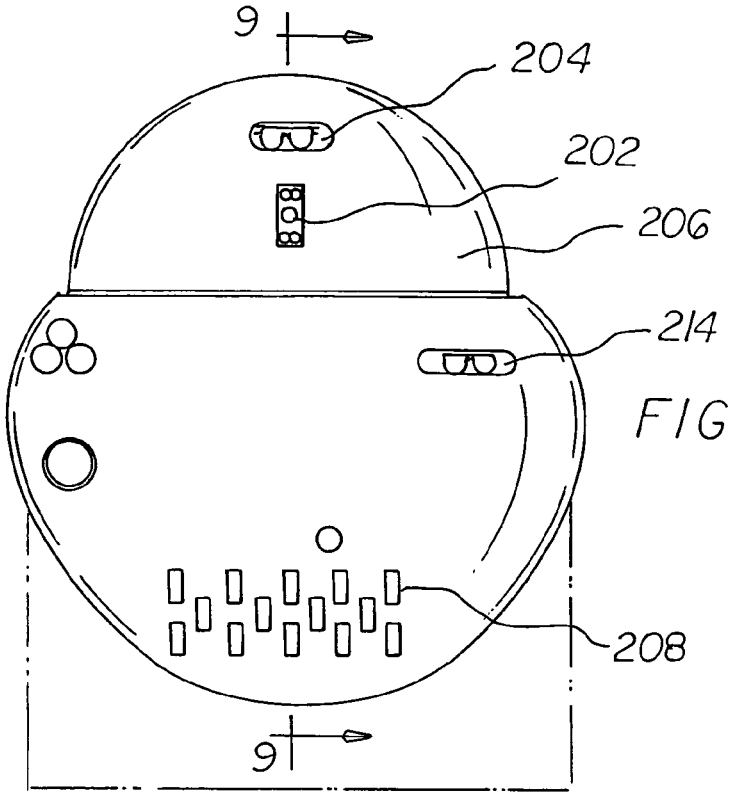
FIG. 8 is a front view of the fighting pod. Note the ripper teeth as well as the viewing ports and weapons systems.
Figure 9:
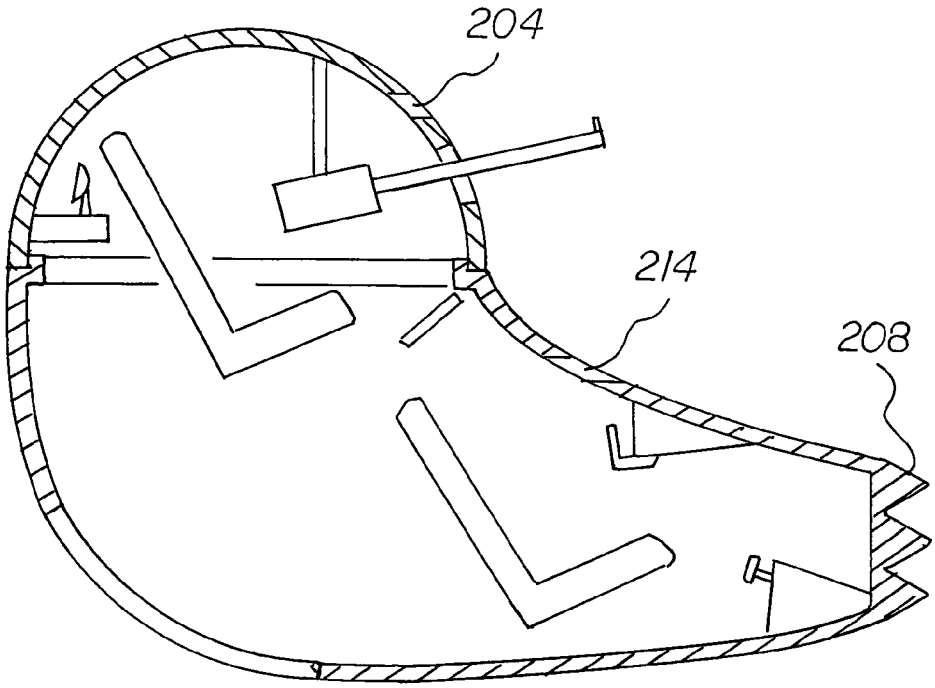
FIG. 9 is a view taken along line 9-9 of FIG. 8, showing a cross section of the fighting pod. The seating configuration is much like the apache helicopter configuration, giving the gunner a clear view forward. The personnel may be replace by remote controlled direction and firing components, so that the fighting pod may be operated without personnel being physically within the pod during enemy engagement. Also note that the pod may serve as a weapons platform for any of the weapons systems, or combination of, which are employed in attack helicopters or battle tanks, except for, of course, the main battle cannon of the tank. Smaller caliber weapons, such as thirty mm chain guns, along with flamethrowers, and/or rocket launcher pods may be mounted either on, or within, the fighting pod.
Figure 10:
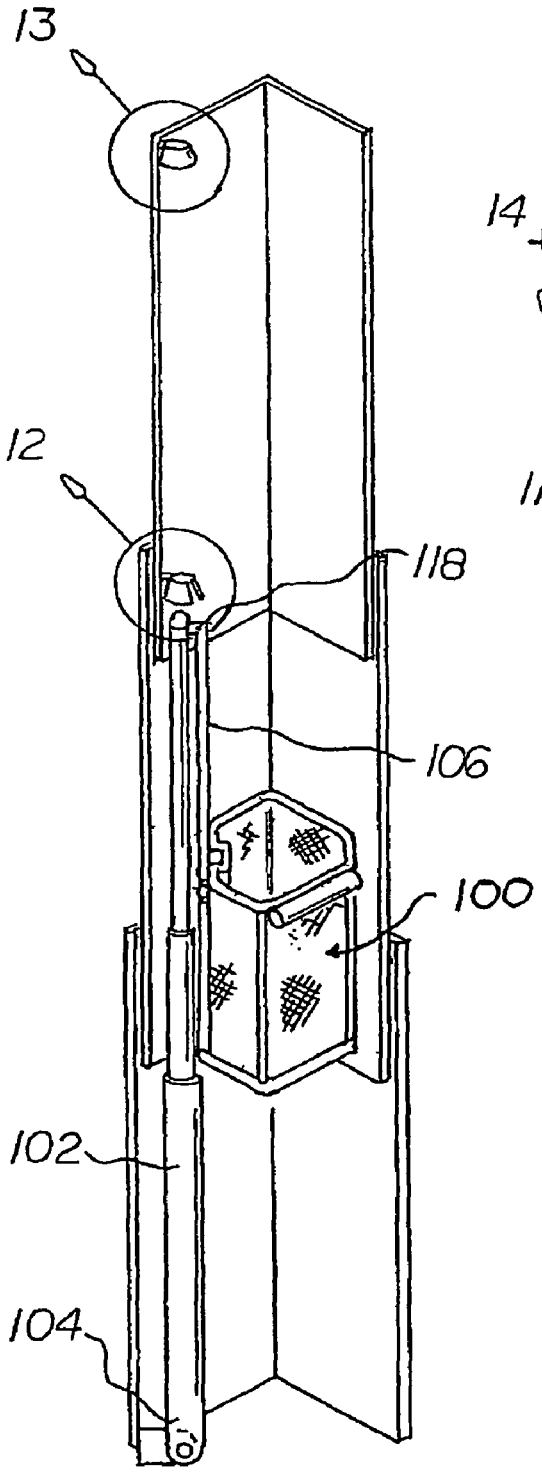
FIG. 10 is a cross sectional view of the boom with the elevator in place.
Figure 11:
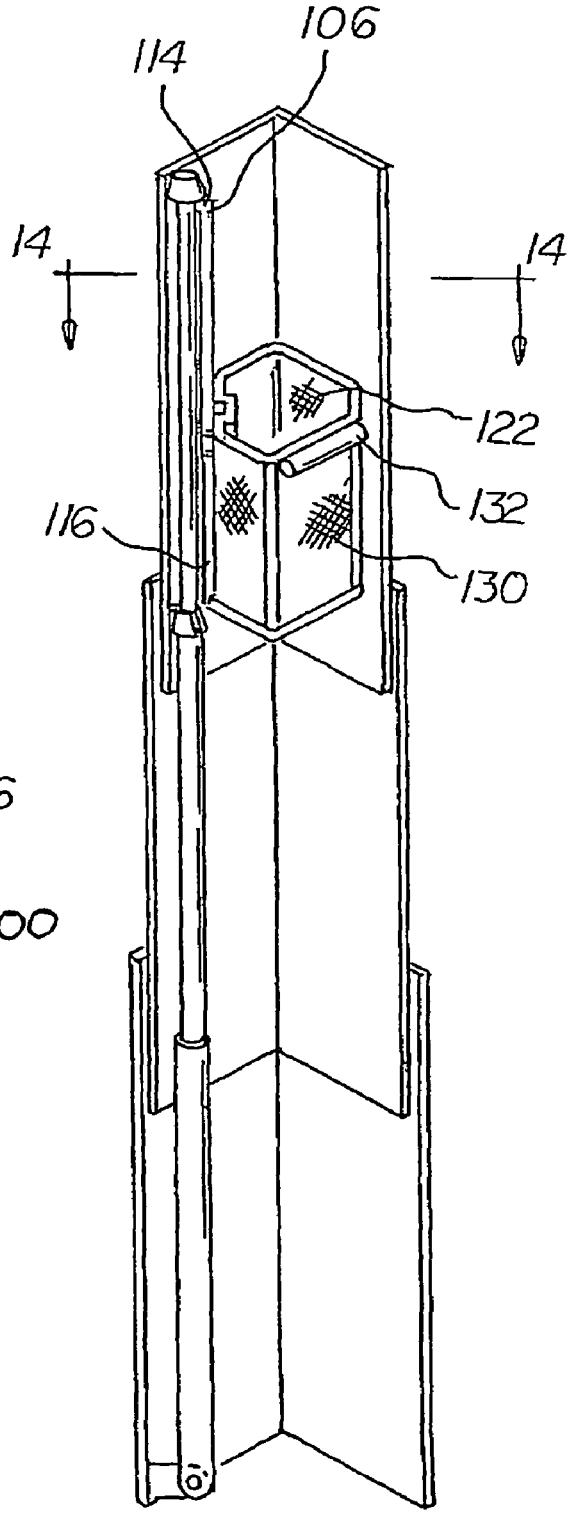
FIG. 11 is a cross sectional view of the boom with the elevator being located at the top of the travel length, so that the end of the ram is engaged within the receiving cup, and the ram passes through the slotted guide. The extending hydraulic cylinder and chase are not shown in FIG. 10 or FIG. 11, so as to provide clarity.
Figure 17:
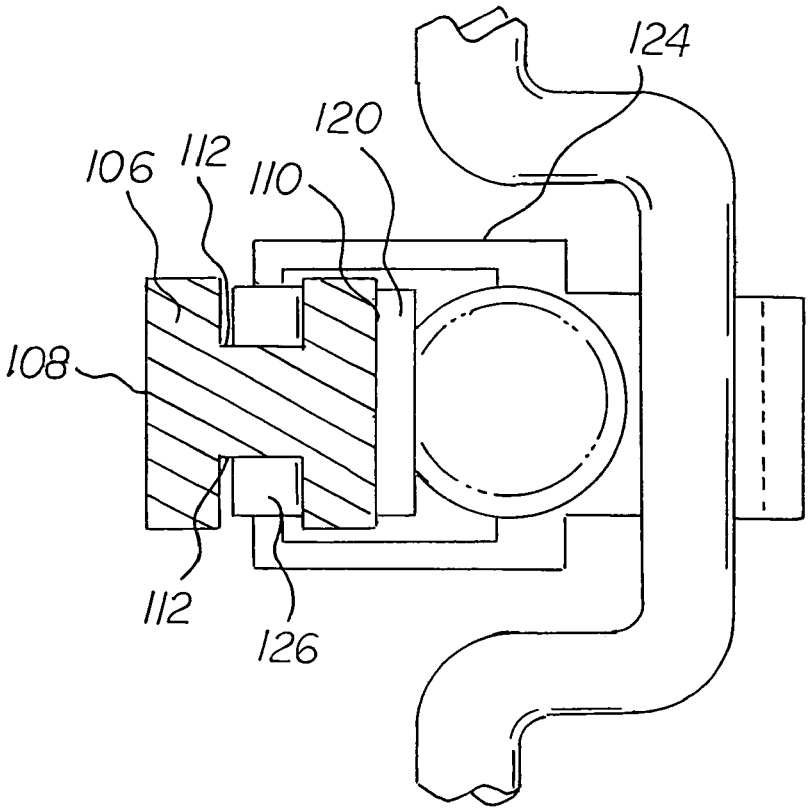
FIG. 17 is a view taken along line 17-17 of FIG. 15.
Figure 18:
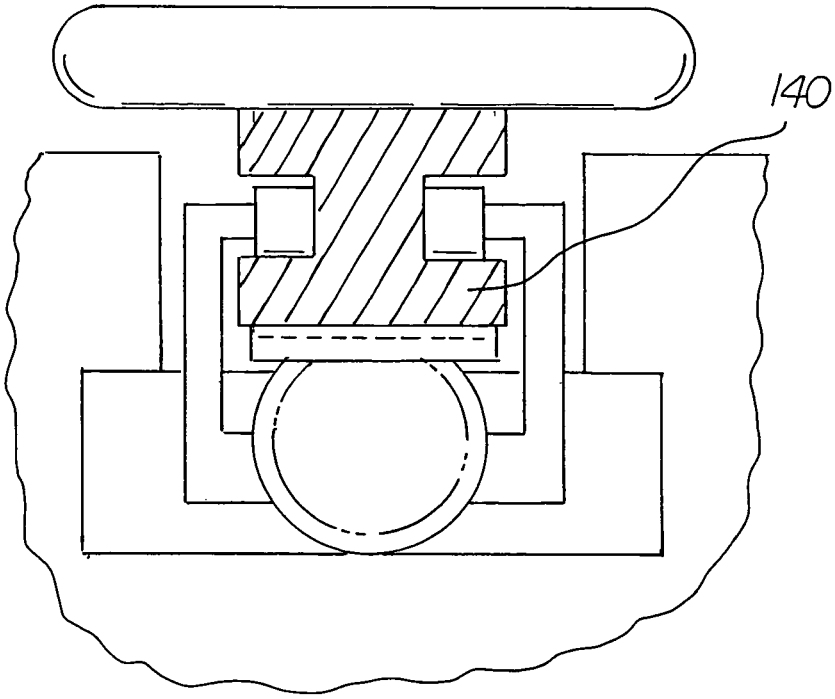
FIG. 18 is a view taken along line 18-18 of FIG. 16.
Figure 19:
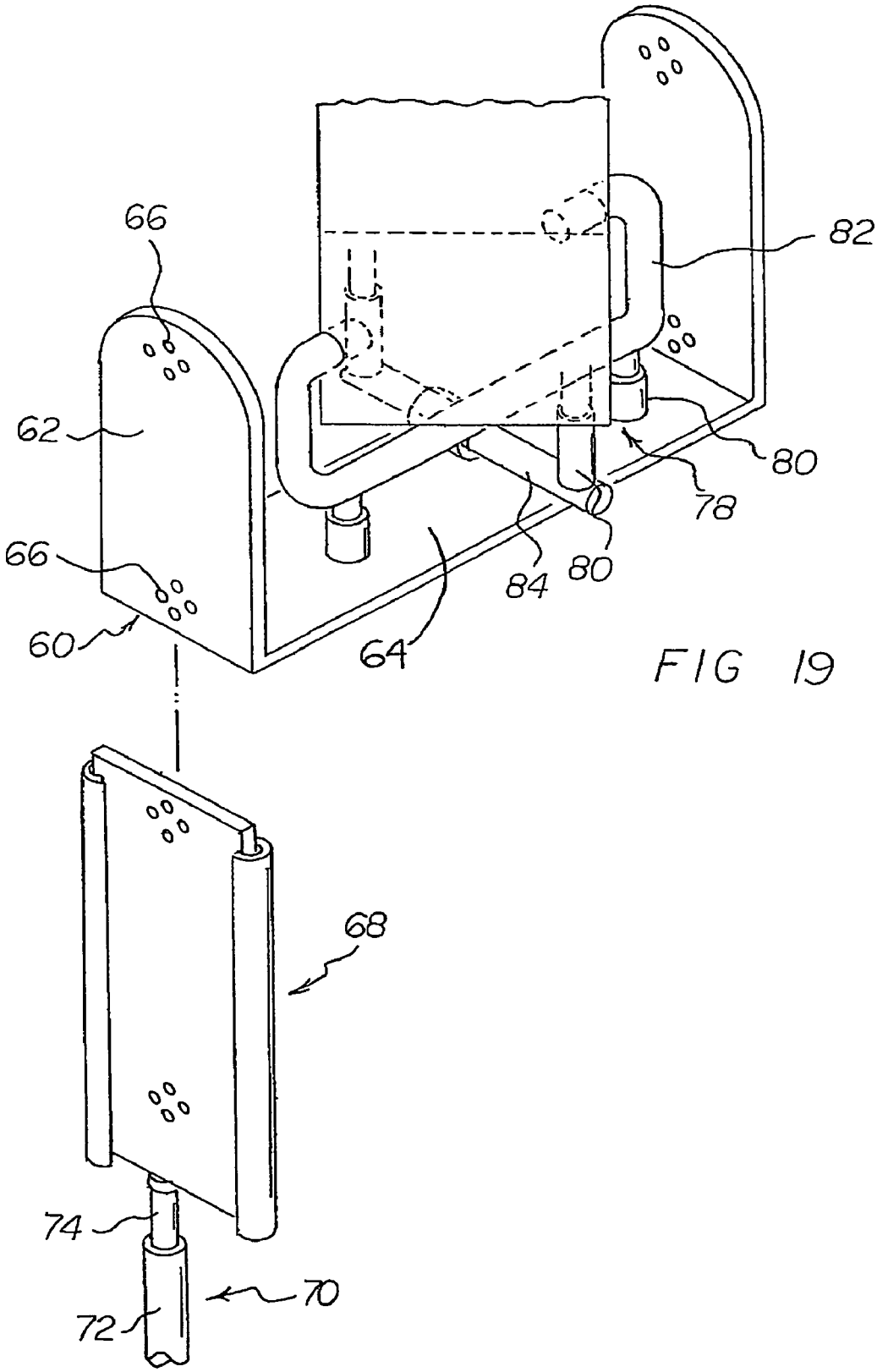
FIG. 19 is a perspective side view of the mounting bracket and gimbal assembly. Note the four hydraulic cylinders the move the boom in a conical shaped area of travel. Also note the plate to which the mounting bracket attaches, and can move up and down in a sliding fashion. This configuration allows for the entire boom to be elevated, so as to allow the boom to, on the end unit side, be lower than would be allowed with a fixed boom mounting configuration.

With reference now to the drawings, and in particular to FIG. 1 thereof, the preferred embodiment of the new and improved an assault vehicle embodying the principles and concepts of the present invention and generally designated by the reference numeral 10 will be described.

The present invention, the an assault vehicle 10 is comprised of a plurality of components. Such components in their broadest context include a vehicle, a boom, and a fighting pod. Such components are individually configured and correlated with respect to each other so as to attain the desired objective.

An assault vehicle comprises several components, in combination. First provided is a vehicle body 12. The vehicle body has an outer surface 14 and an inner surface, with a thickness there between. The body has a front end 16 and a rear end 18. In the preferred embodiment, the vehicle body is the type of vehicle body found on the presently used Striker assault vehicle. In this embodiment, there is a rear door 20 in the body for the ingress and egress of troops.

The vehicle has multiple pairs of rubber tires 22. In other embodiments, a track may replace one side of rubber tires. Such a configuration may be found any one of a number of tanks employed by the armed services, in particular, the Abrams Tank.

The vehicle body has a top surface 24 and a bottom surface 26, with side surfaces coupling the top surface and bottom surface. The surfaces are generally made of a bullet, or projectile, resistant material, such as hardened steel. Such surfaces may, in other embodiments, be covered with projectile resistant grating, such as is currently used on Striker vehicles to retard rocket propelled grenades, thereby reducing the warhead's effectiveness. As in other armored vehicles, some parts of the body are thicker than other parts, due to the tendency for impact to occur on some areas or parts more readily than on others, such as sides and fronts of these types of vehicles.

The inner surface of the vehicle body forms an interior cavity. The vehicle body interior cavity has a driving compartment, an engine compartment, and a payload compartment. The payload compartment may be either use for carrying cargo and supplies, or it may be used to house electronics equipment, or it may be used to transport troops. The payload compartment has an upwardly directed boom aperture 28 therein. The boom aperture is located toward the rear of the upper surface.

The vehicle body has a plurality of associated ground bearing subassemblies 30. The ground bearing subassemblies each have a plurality of associated stabilizing outriggers 32. Each outrigger has a deployed, or down, position and a non-deployed, or up, position. Each outrigger has a vehicle attachment end 34 and a surface bearing end 36 and an associated hydraulic cylinder, the use of stabilizers, including hydraulically activated stabilizers, is so well known the art that the hydraulic cylinders are not shown in the drawings.

The surface bearing end of each of the outriggers has a contact wheel 38 associated there with. The deployed position of each of the outriggers comprises the contact wheel of the outrigger bearing end being in contact with a recipient surface such as the ground, a wall or an embankment. The non-deployed position comprises the outrigger bearing end being free of a recipient surface.

The outriggers act to broaden the base of the vehicle, making it more tip resistant. The advantage of the wheeled stabilizing outriggers is so that the vehicle may move even when the outriggers are down. This is important when the vehicle is in full assault mode, with the boom extended, as when attacking a tall structure, such as a building, or house. If the occasion arises that the vehicle driver needs to move the vehicle, the driver may do so without raising the outriggers, and thereby destabilizing the vehicle, and causing excessive boom sway. Of course, when the boom is in the up position, but not extended, the weight distribution may be such that the deployment of the stabilizers is not necessary for operations.

Stabilizer deployment is controlled by the vehicle operator, and has attendant components which include hydraulic cylinders, pumps, valves, reservoirs and fluids, as well as electronic components, which include sensors, wires, switches, computer controlled electronics, and software programs. Such components are commonly used to regulate and control boom position, and are commonly found in numerous hydraulic systems. As such, the components will not be discussed in detail.

In the preferred embodiment, the wheeled stabilizer has an associated projectile grate 40 associated there with. The projectile grate is configured to have a pair of mounting points on the stabilizers, and a mounting point, via the use of a connecting rod 42, to the body of the vehicle. The connecting rod, along with the stabilizer, the grate, and the body, form a parallelogram, so that as the wheeled stabilizer is deployed into the down position, the grate moves parallel with the body of the vehicle, and maintains itself in a plane generally parallel with the body side wall. In this configuration, the grate is positioned away from the body of the vehicle, and thus, become more protective of the vehicle from launched rocket propelled grenades.

When the wheeled stabilizer is rotated upwards, into the non-deployed, up, position, the grate is elevated, and also remains in the parallel orientation to the vehicle body. The grate, in this configuration, provides additional protection to the existing body grating, which it may overlap.

Next provided is a vehicle boom 50. The vehicle boom comprises several components, in combination. Simplistically stated, the boom is a telescoping tube with a passageway there through. The boom has an elevator within the passageway to facilitate the movement of troops or supplies up the boom.

The boom has a first telescoping tube 52, a second telescoping tube 54, and a third telescoping tube 56. The first telescoping tube has a generally square cross sectional configuration. The first telescoping tube has an exterior surface having a first external dimension, and an interior surface with a first interior dimension. There is formed a wall thickness there between.

The second telescoping tube has a generally square cross sectional configuration. The second telescoping tube has an exterior surface, having a second external dimension and an interior surface with a second interior dimension. There is formed a wall thickness there between. The second exterior dimension is less than the first interior dimension so as to allow the second telescoping tube to be slidably located within the interior of the first telescoping tube.

The third telescoping tube has a generally square cross sectional configuration. The third telescoping tube has an exterior surface having a third external dimension and an interior surface with a third interior dimension. There is formed a wall thickness there between. The third exterior dimension is less than the second interior dimension so as to allow the third telescoping tube to be slidably located within the interior of the second telescoping tubes. The third telescoping tube has a chase 58 therein for carrying conduit there through. The chase is preferably located in the rearward corner of the boom. As most attacks on the vehicle, and boom, will occur from the side or the front, it is more practical to place operating system components to the rear of the boom, away from the point of impact of enemy fire.

In the preferred embodiment the configuration of the boom cross section is square, but other embodiments may include cross sectional configurations which are rectangular, triangular, and round. When mounted on the vehicle, the square boom configuration has a forward angle located forwardmost, so as to provide angled surfaces to fire coming directly from ahead.

A boom mounting bracket 60 is used to pivotably mounting the boom to the top surface of the vehicle body at an area of attachment. The boom mounting bracket has an upper component 62 and a lower component 64. The upper component has a pair of upwardly projecting bracket legs, having a plurality of bolt holes 66 on each of the upward extents of both of the bracket legs. The lower component comprises a cross member between the two upwardly disposed bracket legs, and operatively connects the two bracket legs in a generally U-shaped configuration.

The boom bracket is coupled to the vehicle with the employment of a boom receiver 68, which has an upper and lower travel. The travel is controlled by a boom bracket travel hydraulic cylinders 70. This configuration allows the entire boom to be moved up and down relative to the vehicle, adding more reach, or allowing the boom to be raised and then tipped forward, so as to be positioned below the vehicle, such as in over bridge-side searching operations, or searching along banks located near roadways. This mode of operation will be important when the boom is equipped with a blast shield and explosive sniffing system. The upward travel will allow the boom to be extended and placed down on the roadway with the purpose of searching suspect areas for hidden improvised explosive devices.

The boom bracket travel hydraulic cylinders are controlled by the hydraulic system of the vehicle, and connected thereto. The boom bracket travel hydraulic cylinders each have a base 72 and a movable ram 74. The bases of the cylinders are coupled to the vehicle. The rams of the hydraulic cylinders are coupled to the boom receiver. This configuration allows the boom mounting bracket to have an upwardly extended deployment configuration, and a retracted non-deployed configuration. The ability to elevate the boom mounting bracket allows a greater reach with minimizing the boom carrying length. The retractable boom mounting bracket also allows for the boom to be carried and stored in close proximity with the top surface of the vehicle, and reduces overall vehicle height, which must be kept to a minimum for shipping and logistical purposes.

During initial deployment, the boom and boom mounting bracket may be removed from the vehicle and shipped separately. This may be the case when the vehicle is to be transported by aircraft, such as may occur in rapid deployment situations. With the boom removed, the vehicle is lower, or as low as, the presently existing striker vehicle. Upon arrival, the boom is lifted by a lifting truck, such as a tank retriever, and then mounted on the vehicle. The boom and hydraulics are then connected, and the vehicle is placed in service.

The boom mounting bracket has a protective skirt 76 overlying the area of attachment to the vehicle body top surface around the lower portion of the boom mounting bracket. The boom skirt protects against small arms fire entering the vehicle from locations above the level with of the top of the vehicle, such as from roof tops, trees, or rises in elevation.

The boom mounting bracket has a gimbal mount 78 and four lift hydraulic cylinders 80. The gimbal mount and lift hydraulic cylinders allow the boom to be moved within a conically shaped area.

The first mount, or side to side pivoting gimbal comprises a generally C-shaped frame 82. The second mount, or front to back pivoting mount has a generally straight tubular form 84. The straight form acts as a base upon which a first pair of hydraulic cylinders, the front to rear tipping cylinders, reside. The second pair of cylinders, the side to side rocking cylinders are connected to the lower surface of the pivoting gimbal, and provide side to side rocking of the boom. The gimbal, straight form, and cylinders are coupled to a removable mounting bracket. In this manner, the mounting bracket, attached to the boom, may be added to a Striker vehicle upon arrival into an area of operations. The removable quality of the boom mount allows the boom to be removed from, or attached to, a vehicle with a simple operation.

The gimbal location and operation is controlled by a plurality of sensors (not shown, but known in the art) which sense the boom location relative to the vehicle, and stabilize the boom in such relation. The computer (not shown) controlled locating of the boom maintains the overall balance of the vehicle, and allows the vehicle to move slowly with the boom up, and in a fighting, or assault, position.

The boom has a hydraulic extending system comprising at least one hydraulic cylinder 90 for slidably extending and retracting the boom telescoping tubes. The extending system is located within the interior of the boom, passing through the chase of the third tube of the telescoping boom. The locating of the hydraulics within the boom protects the hydraulic system from projectiles.

The extending system is located within a corner of the cross sectional area. The corner which protects the extending system is reinforced so as to offer greater protection from projectiles. As with all hydraulic systems, there is a power source, such as an internal combustion engine, coupled to a hydraulic pump and pump reservoir. Within the reservoir is contained the hydraulic fluid, which is used to actuate the hydraulic cylinders to extend or retract. Valves, used to direct the fluid, bring about the actuation of the hydraulic cylinders.

The boom extension is carried out using the technology which is commonly available in the earth moving machinery, such as the articulating bucket vehicle referred to as a "Grad-all". The boom in the present invention extends and retracts, and has rotational capabilities, as does the commonly available excavation equipment referenced above.

As described, the boom comprises a hollow tube. The tube has a side to side dimension of about four feet, with a diagonal dimension of about 5 feet. This allows ample room for the transport of troops up through the boom to the pod, and will be further discussed below.

Electrical power is conducted to the uppermost extent of the boom by way of a electrical cable 92. The cable is a springed coiled metal cable, having an electrical line attached along the metal cable's length, thereto. The coils form an interior passageway, which runs through all the coils. A telescoping rod 94 assembly is coupled to the boom mounting bracket and the uppermost extent of the third, inner, telescoping tube. As the boom is extended, the telescoping rod assembly also extends, with the coil, coupled to the electrical wire, also extending. The rod running through the wire coils keeps the wire in the proximity of the rod, and prevents the wire from entanglement and breakage. At the uppermost extent of the telescoping rod is a electrical connecting point (not shown), to which the electrical wire is electrically coupled, providing a "power point" at the uppermost extent of the boom telescoping (innermost) tube.

There is an internal boom elevator 100 located within the boom. The boom elevator is coupled to the boom mounting bracket and travels with the boom, such that boom pivot and boom rotation are matched by the boom elevator movement. The internal boom elevator has an uppermost position, or deployment, and a lowermost position, or non-deployment, and an area of transition there between. The internal boom elevator comprises several components, in combination, and is described below.

The first component of the boom elevator is a hydraulic cylinder with a slidably movable ram 102, as is commonly found in hydraulic cylinders. The hydraulic cylinder has a base 104, having an inside, an outside, and a length. The base is coupled to the boom mounting bracket. The ram of the hydraulic cylinder, which moves within the base, has a length. The length of the ram is greater than the length of the hydraulic cylinder base. The ram has a lower most extent, in which a major portion of the length of the ram is contained within the cylinder base, and an uppermost extent, which a major portion of the length of the ram is outside of the cylinder base. In this configuration, the ram is said to be "extended".

The uppermost extent of the ram has an associated end track 106 coupled thereto. The end track is a straight length of generally I-shaped steel having an outer side 108, and an inner side 110, and two parallel recessed sides 112, hence the referral to the I-shape. The end track has an upper end 114 and a lower end 116. At the uppermost end of the end track there is a linking arm 118 which connects the end track with the ram uppermost end.

The linking arm is generally perpendicular to the ram length and the end track length, and maintains the end track in a generally parallel orientation with the ram, and away from the ram. The end track linking arm extends from the ram, and the end track runs parallel with and downward from, the uppermost extent of the boom elevator cylinder ram. The end track protrudes to the side of the ram, with a space being between the ram and the end track so as to allow the ram to be withdrawn into the cylinder, and have the end track clear the outside of the cylinder wall.

The inner side of the end track comprises an elevator cage gear rack 120 and an end stop. The elevator cage gear rack is coupled to the end track of the hydraulic cylinder. The end stop is located at the lowermost end of the end track gear elevator cage gear rack.

The next component of the boom elevator is an elevator cage 122. The elevator cage is coupled to the end track by a mounting bracket 124. The mounting bracket has a plurality of rollers 126 which are engaged within the side recesses of the I shaped end track. The elevator cage is coupled to the elevator cage gear rack so that it can be slidably moved up and down the end track.

There is an associated first electric motor and first worm gear coupled to the elevator cage. The first electric motor and first worm gear are mounted and configured to engage the elevator cage gear rack, so as to allow the cage to ride up and down the end track of the ram. The electric motor receives power from the power point at the uppermost extent of the boom telescoping (innermost) tube, and is electrically coupled thereto.

The elevator cage has a plurality of sides 130, with an overlying mesh. The sides each have a lower extent and an upper extent and a length there between. Each of the sides has two parallel side edges. The side edges of the cage sides are coupled together so as to form a generally hexagonal tubular configuration, thereby forming a cage located within the telescoping boom. The cage has one of the sides of the cage comprising a door 132 located on the lower end of the side and extending upward about three fourths the length of the side, to allow entry and exit to and from the cage when the cage is in the lowermost, non-deployment, position. In the preferred embodiment, the door is a "roll up" door, as is commonly found in the market place.

The cage side which is generally opposite of the cage door has a floor gear rack 140 which runs from the lowermost extent of the cage side to the uppermost extent of the cage side. The floor gear rack has a generally I-shaped configuration and the floor gear rack forms a mounting point for the cage floor. The cage has a movable floor 142. The floor has an upper surface, a bottom surface, and a thickness there between. The thickness of the floor comprises a side edge. The floor has an escape panel 144 aperture therein.

The cage floor has a second associated electric motor having a second worm gear. The cage floor electric motor is coupled to the cage floor, and the cage floor electric motor worm gear is engaged in the elevator cage floor gear rack which is coupled to the cage side. This configuration allows the cage floor to ride up and down within the interior of the elevator cage. The cage floor electric motor, like the elevator cage electric motor, is electrically coupled to the power point which is located at the uppermost extent of the boom telescoping (innermost) tube, and is electrically coupled thereto. There is an emergency cut off switch for the cage floor electric motor, which allows a person in the cage to prevent the floor from moving upward or downward.

The floor has an associated escape panel 146. The escape panel has an upper surface, a bottom surface, and a thickness there between. The thickness comprises a side edge of the escape panel. The floor escape panel has an associated hinge 148 which couples the side edge of the floor escape panel with the floor escape aperture. The escape panel has a closed position and an open position. The floor escape panel has a securement catch (not shown, but well known in the art) to maintain the escape panel in a closed position. The escape panel open position allows for entry and exit to and from the cage through the floor escape aperture when the cage is out of the non-deployed position. The floor has an attachment point 150, in the form of a latching ring for the attachment of an emergency descent rope.

The next component of the boom elevator is a ram guiding sleeve 160, also known as a "sleeve guide", or simply "guide". The ram guiding sleeve has a mounting plate 162 and a guide 164. The guide has a top extent 166 with a top internal dimension and external dimension, and a bottom extent 168 with a bottom internal dimension and external dimension.

The guide has a generally C-shaped configuration, with an outer surface and an inner surface. The inner surface of the guide comprises a general taper along the inner surface length. The taper runs from guide sleeve bottom to guide sleeve top. The bottom internal dimension of the guide is larger than the top internal dimension of the guide, thereby forming the taper. The C-shaped configuration of the guide defines a slot 170 in the guide sleeve, with the slot running from the bottom extent of the guide sleeve to the top extent of the guide sleeve. The slot allows the passage there through of the ram end track as the ram of the boom elevator moves through the guiding sleeve. The guiding sleeve is important in that it forms a stabilization point for the boom elevator ram, so as to minimize side to side movement when the boom elevator ram is extended. The taper allows some movement in the ram as it approaches the guide, but the enlarged entry area provides a means for the guide to capture the ram end, and then guide it up through the guide, and through the guide. The slot, as stated above, allows the end track to move through the guide, along with the ram end.

As the elevator ram is moving upward, taking with it the elevator and the contents, which may be troops or supplies and munitions, the ram has a tendency to sway, as the length from the base mounting increases. The guide captures the ram, and prevents swaying from that point onward. The smallest dimension of the taper is sized to fit the external diameter of the ram. The taper may either be a lubricated surface, such as a greased metal, or it may have a liner 172, such as a high impact plastic, which would be slippery against the oiled surface of the ram. The object is to have a coacting surface which would not damage the surface of the ram. A plastic insert is preferred, in that such an insert could be readily changed and would be relatively inexpensive to replace.

The last component of the boom elevator is a ram receiving cup 180. The ram receiving cup has a mounting plate 182 and a cup portion 184. The cup portion has a generally hemispherical configuration, with a downwardly convex external surface and a downwardly concave internal surface, forming an inverted cup. The cup forms a receptacle for the elevator boom ram end, so as to anchor the ram end, and therefore anchor the boom elevator hydraulic cylinder at both the base and the ram end, providing a stable, and generally fixed "post" for the operation of the boom elevator.

The final component of the assault vehicle is a fighting pod 190. The fighting pod has a lower portion 192, an upper portion 194 and a ramming portion 196. The lower portion has a generally rounded configuration with a lowermost extent. The use of the word "rounded" is to mean that there are generally curved surfaces having a generally convex exterior surface. It includes the areas of the fighting pod which are generally flattened or curved in only one direction, so as to be "tube like". The word "rounded" is not limited to ball shaped configurations.

The lowermost extent has a location 198 for the coupling of the fighting pod to the third telescoping tube of the boom. The fighting pod has a protective skirt 200 associated with the place of joining of the pod to the boom.

The lowermost extent of the fighting pod further comprises a boom elevator aperture, having an associated door. The lowermost extent comprises a coupling location for coupling the fighting pod to the boom. The fighting pod also has at least one weapons mounting location 202, as well as at least one viewing port 204. The upper portion of the fighting pod comprises a rotatably mounted turret 206 having a mounted weapon. The ramming portion is forward of the lower portion and has a generally tapered forwardmost end, with a plurality of ripping teeth 208 thereon.

The preferred embodiment fighting pod has seating for two personnel, though one operator could operate the functions of the pod. The personnel are one positional operator and one gunner. The pod would be electrically connected to the "power point" at the end of the boom. In another embodiment, the pod has a diesel engine which generates both hydraulic power and electrical power to run the systems in the pod.

The pod systems are a turret with a heavy machine gun and/or a belt fed grenade launcher. An alternative weapon may be a flame thrower. In this configuration the boom would have a coiled flammable liquid line with a quick disconnect, as is known in the art, for connecting the flame thrower to the flame thrower fuel tank housed in the compartment of the vehicle.

In other embodiments, the pod has side doors 210 which allow the driver or operator to load rockets within the pod, and then open the side doors, and move the launchers into the launch position, outside of the pod, where the rockets would be launched.

The pod floor has a door which covers the aperture at the connecting point of the boom. The door remains closed until the ram end engages the cup, thereby moving the elevator into a proximate position to the floor aperture. At this time, the door may be opened, and the elevator cage moved up to the uppermost position. The floor of the elevator cage then moves the contents of the elevator, upwards until the floor of the elevator is near the floor of the fighting pod. In this way boxes of ammunition may be readily moved into the pod, without any lifting, but merely moving the elevator floor into the uppermost position.

In the preferred embodiment, the pod has a side external door 212, which can be opened from inside of the pod. This allows the pod to be placed on the roof of a building, clearing the roof with machine gun fire, or flames from the flame thrower. Troops from inside the vehicle can be moved up to the pod by the elevator, and then exit the pod, through the pod door, onto the roof. A typical use is described below.

The advantages and uses of the vehicle are herein described. The vehicle, in the preferred embodiment, can transport troops to an area, such as a house or a street location. When resistance, in the form of fire, is directed toward the vehicle, the rear door of the vehicle opens, and the troops deploy in a defensive position around the vehicle. The vehicle driver clears the pod to engage. In doing so, the vehicle outriggers are deployed into a ground bearing position, to stabilize the vehicle and to provide additional protective grate distance between the vehicle and the grate. If the pod is only going to elevate to the first length of boom, then the driver of the vehicle may elect not to deploy the outriggers.

The pod operator, and accompanying gunner, then elevate the boom and fighting pod into an attack position, which, in this scenario, is having the pod elevated one length of boom tube, or about fifteen feet above the vehicle.

The pod commander and gunner may have been previously positioned within the pod. The pod may have, in an alternate embodiment, a separate power source, such as a small diesel engine. Diesel is preferred because it is less explosive than gasoline, though gasoline may be used as a fuel.

The internal combustion engine, or turbine engine, provides power to the pod for running the gun systems, flamethrower system, and rocket system, as well as providing power to run HVAC and electronics systems. In some cases the pod commander and gunner may enter the pod upon arrival at the area of operations.

The pod is mounted on a ring gear turning mechanism, known in the art, for allowing the pod to rotate, much like a turret. Front to rear tipping of the pod is accomplished by rotation motors positioned on either side of the boom used in conjunction with a gimbal, to allow the pod to tip forward and rearward through about 70 degrees. The pod also has a side to side tipping mechanism, comprising a curved rack and worm gear drive motor. The tipping mechanism is located to the rear of the boom, so as to not impair the passageway through the boom into the pod. All pod movement may be either achieved by hydraulic power, by electrical power, or by a combination of both.

In the preferred embodiment the gimbal of the pod is motivated by electrical power, such as electric motors, or an electric/hydraulic configuration, which is well known in the art.

The pod access floor door is located between the gimbal, and the orientation of the pod floor door and the top of the boom, or passageway, is not affected by the pivoting of the pod in any direction. The floor door remains closed until the elevator cage approaches the pod, when sensors allow the floor door to be opened. There is an emergency release (not shown) which allows the floor door to be opened, should the pod operator and gunner need to hastily leave the pod interior. The interface between the pod and the boom comprises a pair of interdigitating armored skirts. The skirts ride on each other to eliminate any openings below the pod.

The pod driver may direct the driver to move the vehicle forward, into a contact position with a house or building. The boom, and pod, may be rotated by the pod operator. The rotation is controlled by a rotation means, which is commonly known in the art. In the preferred embodiment, the boom receiver comprises a rotating gear drive, which rotates the boom receiver within the vehicle. Such rotation gears are known in the art and are not, there fore, illustrated. The rotation means is a hydraulically operated pivoting device, which enables the boom to be rotated about the long axis of the boom, which is the axis that runs from uppermost to lowermost extents, along the interior of the boom. This is also referred to as the "long axis" of the boom.

At the base, or lowermost extent, of the boom the boom bracket comprises a rotation ring and drive means, which is hydraulic, though, in other embodiments, the drive means may be an electric drive. The bracket has a gimbal mounts for the boom, and each end of each end of the gimbal has an associated lift hydraulic cylinder. The lift cylinders are in addition to the lifting cylinders used to move the boom into an upright orientation, or the cylinders used to extend the boom, or to extend the mounting bracket. The orientation cylinders are separate from the other hydraulics used to position and move the boom.

The pushing and pulling of each pair of lift cylinders will bias the boom in a particular direction. A play of all four cylinders will allow the boom to be moved to any location in a conically shaped area, with the apex of the cone being at the base of the boom. This allows the boom, not only to be pivoted up and down and then extended, but to be moved in a conical shaped motion.

The pod's weapon systems can then return fire, and if so desired, the pod operator may move the pod on to the building rooftop. The pod operator can sweep the rooftop with machine gun fire, to clear the roof top of enemy combatants. Once the roof is secured, the pod driver signals the vehicle driver to move troops up to the pod. Two troops at a time are loaded onto the elevator, and moved up, by way of the elevator ram, to a position below the pod.

With the elevator at the lowest location, the roll-up door is opened, and pairs of troops may move into the elevator. The roll-up door is lowered, the elevator secured, and then the elevator is set upwards, toward the pod.

The elevator is raised up until it is near the bottom of the pod when the elevator ram contacts the ram receiver. Location sensors (not shown, but known in the art) determine that the ram is registered into the ram receiving cup. At this point, sensors allow the pod floor door to be opened, and the floor of the elevator then moves the troops up, into the pod, where they exit the pod through the side escape hatch, and take up assault positions on the roof. The elevator is returned to the vehicle, and two more troops are sent up, and onto the roof.

The lift may be used to move troops up the boom, or to move supplies, such as ammunition, ordinance or water from the vehicle to the pod. The ability of the floor of the elevator to move up through the cage allows the stacking of supplies, with the supplies arriving at floor location in the pod, making unloading and resupply easy to accomplish.

When the full assault team is in position on the roof, they move out onto the roof and down the stairwells of the building, flushing the enemy out of the building, where they can be taken prisoner, or destroyed.

Once the troops are off the roof, the pod may move back and downward, one story at a time, to lend fire support to the team as it clears the building. If the troops encounter heavy return fire from one section of the building, they may withdraw to a defensive position away from the resistance. The pod can then direct heavy machine gun fire, such as .50 caliber machine gun fire, or the flamethrower stream, into the area from where resistance arises.

This is repeated until the troops exit the building, and the building is declared secured.

The pod may have, in addition to the pod side door, a number of attachment points for escape ropes. When used, the gunner and pod operator may have to exit the pod in a rapid manner. If unable to go down the boom, the operator and gunner may hook a rope line to the outside of the pod, and rapidly descend to the ground.

Other applications may be using the pod as an unmanned rocket launcher, remotely fired machine gun, or as an armored platform for a sniper team. The list of applications is only limited by the imagination, and includes all applications where altitude or elevation is an important factor. The various configurations which may be attached to the boom for carrying out various functions, are referred to as "end units".

One can also see that the boom concept may be applied to dealing with Improvised Explosive Devices, or IED's. The pod may be removed, and a shield head end unit, comprising a blast shield, an explosive sniffer, a camera, and an air blast gun, may be deployed. The bracket mount is extended, so that the pivoting base of the boom is elevated, meaning that the end of the boom, or the shield head, is at ground elevation. The boom can be extended to a suspected explosive. The sniffer is robotically inserted into the car or debris pile, and if explosives are detected, the area is secured, and an explosives team is called in to eradicate the danger. If no explosives are detected, the air blast gun is used to pressure-push the debris pile apart. Other types of ordinance disposal may be used, such as using the blast shield to place detonating ordinance in the proximity of an explosive device. The shield is removed, the vehicles backed away, and the ordinance is detonated, destroying any bomb that may be hidden within the debris pile.

The assault vehicle, herein described, may be used in conjunction with dug-in positions or revetments. Used in this capacity, the boom may be extended upward, forming an armored "watch tower" from which to direct fire, or directly fire on approaching enemy troops.

The assault vehicle described herein, also referred to as the "T-Rex" is designed to provide, by a mechanical means, the most important advantage of the battlefield, elevation. Simply put, high ground is the most defensible ground. The boom of the T'Rex lifts a heavily armored, an lethally armed, fighting pod to heights of up to sixty feet. Any weapons system that can be put on a tank (with the exception of the 120 mm main gun), helicopter, or fighter aircraft can be mounted at the end of the boom. The fighting pod is sized to about the size of a small compact automobile.

Civilian applications include airport security, dock security, and border security.

Most significant is the utilization of the present system on the modern battlefield. The assault vehicle would make the assault of fixed structures, such as tenement buildings and houses, less dangerous. The elevation advantage of the T-Rex, along with the capability to deliver substantial suppressive fire, and fire itself (flamethrower), makes it an urban force that few are capable, or willing, to reckon with.

In the open field, away from structures, the T-Rex may be deployed within rough terrain, raising above the terrain to observe the area. The T-Rex may be positioned within a tree line, rising up from time to time to peek above the trees to the distance, and then disappearing below the tree line, much like the periscope of a submarine.

In the urban environment, the T-Rex may batter its way through walls, fences, and even through the sides of buildings, providing the ability to neutralize the enemy within with its varied weapons systems. The height of the T-Rex, when fully deployed, would allow sniper teams to use the platform as an observation and shooting position. The ability to remove a sniper team from height, while keeping the team within an armored shell, has many unstated advantages. The height of the T-Rex, along with the long distance precision sniping capabilities of the armed forces provides an added layer of security for ground troops.

With the use of interchangeable end units, the pod can be replace with a remote controlled mini gun, or rocket pod. Also, the end unit may have a bomb detection and management device, such as a blast shield, along with bomb detection "sniffers" and a debris dispersion air gun.

Lastly, the mobility of the vehicle, along with the ability to extend the boom, allows the vehicle operator to send the fighting pod out into a street or alley way, without exposing the vehicle's location.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An assault vehicle, comprising, in combination:

a vehicle body;

a plurality of telescoping tubes comprising a vehicle boom being coupled to the vehicle body, the vehicle boom having a vehicle mounting end and an uppermost extent and the vehicle boom having a passageway there in;

a fighting pod having an uppermost extent and a lowermost extent, the pod being coupled the uppermost extent of the vehicle boom with the passageway allowing passage from the vehicle body to the fighting pod, the lowermost extent of the fighting pod having a boom elevator aperture there through;

the vehicle body having an outer surface and an inner surface, with a thickness there between and a top surface and a bottom surface with side surfaces coupling the top surface and bottom surface, the inner surface of the vehicle body forming an interior cavity;

the plurality of telescoping tubes comprising a first telescoping tube and a second telescoping tube and a third telescoping tube, with the first telescoping tube having a generally square cross sectional configuration, with the first telescoping tube having an exterior surface having a first external dimension and an interior surface with a first interior dimension with a wall thickness there between, the second telescoping tube having a generally square cross sectional configuration, with the second telescoping tube having an exterior surface having a second external dimension and an interior surface with a second interior dimension with a wall thickness there between, the second exterior dimension being less than the first interior dimension so as to allow the second telescoping tube to be slidably located within the interior of the first telescoping tubes, the third telescoping tube having a generally square cross sectional configuration, with the third telescoping tube having an exterior surface having a third external dimension and an interior surface with a third interior dimension with a wall thickness there between, the third exterior dimension being less than the second interior dimension so as to allow the third telescoping tube to be slidably located within the interior of the second telescoping tubes;

the vehicle boom comprising:

a boom mounting bracket;

a hydraulic boom extending system comprising at least one hydraulic cylinder for slidably extending and retracting the boom telescoping tubes;

an internal boom elevator coupled to the boom mounting bracket; and the fighting pod having a lower portion and an upper portion and a ramming portion.

2. The assault vehicle as described in claim 1, with the vehicle further comprising:

the vehicle body interior cavity having a driving compartment and an engine compartment and a payload compartment, the payload compartment having an upwardly directed boom aperture therein;

the third telescoping tube of the boom having a chase therein for carrying conduit there through;

the vehicle boom further comprising:

the boom mounting bracket pivotably mounting the boom to the top surface of the vehicle body at an area of attachment;

the boom elevator further comprising:

the boom elevator being located within the boom and being coupled to the boom mounting bracket, the internal boom elevator comprising:

a hydraulic cylinder with a slidably movable ram, the hydraulic cylinder being coupled to the boom mounting bracket, the ram of the hydraulic cylinder having an associated end track coupled thereto;

an elevator cage gear rack coupled to the end track of the hydraulic cylinder;

an elevator cage being coupled to the elevator cage gear rack so as to allow the cage to ride up and down the end track of the ram; and a ram guiding sleeve having a mounting plate and a guide; and a ram receiving cup having a mounting plate and a cup portion;

the fighting pod lower portion having a generally rounded configuration with a lowermost extent with the lowermost extent having a location for the coupling of the pod to the third telescoping tube of the boom.

3. The assault vehicle as described in claim 2, with the vehicle further comprising:

the vehicle body having a plurality of associated ground bearing subassemblies, the ground bearing subassemblies having a plurality of associated stabilizing outriggers, each outrigger having a deployed position and a non deployed position, each outrigger having a vehicle attachment end and a surface bearing end;

the vehicle boom further comprising:

the boom mounting bracket having an upper component and lower component;

the internal boom elevator having an uppermost deployment and a lowermost deployment and an area of transition there between;

the elevator cage having a plurality of sides with an overlying mesh, with the sides each having a lower extent and an upper extent;

the ram guide sleeve having a top extent with a top internal dimension and external dimension, and a bottom extent with a bottom internal dimension and external dimension, the sleeve guide having a generally C-shaped configuration with an outer surface and an inner surface;

the ram receiving cup portion having a generally hemispherical configuration with the cup portion having a downwardly convex external surface and a downwardly concave internal surface; and the fighting pod having a protective skirt associated with the place of joining of the pod to the boom.

4. The assault vehicle as described in claim 3, with the vehicle further comprising:

the surface bearing end of the ground bearing assemblies each having a contact wheel associated there with, the deployed position of each of the outriggers comprising the contact wheel of the outrigger bearing end being in contact with a recipient surface, the non deployed position being the outrigger bearing end being free of a recipient surface;

the boom mounting bracket upper and lower components being slidable coupled and having an associated hydraulic cylinder, the hydraulic cylinder having a base and a movable ram, the base of the cylinder being coupled to the lower component of the boom mounting bracket and the ram of the hydraulic cylinder being coupled to the upper component of the boom mounting bracket so as to allow the boom mounting bracket to have an upwardly extended deployment configuration, and a retracted non-deployed configuration;

the elevator cage sides being coupled so as to form a generally rectangular tubular configuration thereby forming a cage located within the telescoping boom;

the elevator cage having a movable floor, the floor having an upper surface and a bottom surface and a thickness there between, the thickness of the floor comprising a side edge;

the ram guide sleeve inner surface comprising a general taper along the inner surface length with the taper running from sleeve guide bottom to sleeve guide top, with the bottom internal dimension of the sleeve guide being larger than the top internal dimension of the sleeve guide, the C-shaped configuration of the sleeve guide defining a slot in the sleeve guide running from the bottom extent to the top extent of the sleeve guide, the slot allowing the passage there through of the ram end track; and the fighting pod lowermost extent comprising a coupling location for coupling the fighting pod to the boom, the lowermost extent also comprising a weapons mounting location and a viewing port, the upper portion comprising a rotatably mounted turret having a mounted weapon, the ramming portion being forward of the lower portion.

5. The assault vehicle as described in claim 4, with the vehicle further comprising:

the boom mounting bracket having a protective skirt overlying the area of attachment to the vehicle body top surface around the lower portion of the boom mounting bracket the elevator cage having one of the sides comprising a door to allow entry and exit from the cage when the cage is in the lowermost deployment position;

the elevator cage floor configured to allow the cage floor to ride up and down within the interior of the elevator cage, with the floor gear rack running from the lowermost extent of the cage side to the uppermost extent of the cage side; and the ramming portion of the fighting pod having a generally tapered forwardmost end with a plurality of ripping teeth thereon.

6. The assault vehicle as described in claim 5, with the vehicle further comprising:

the elevator cage floor having an escape panel aperture therein, with the floor escape panel having an upper surface and a bottom surface and a thickness there between, the thickness comprising a side edge, the escape panel having a closed position and an open position, the floor escape panel having an associated hinge coupling the side edge of the floor escape panel with the floor escape aperture, the floor escape panel having a securement catch to maintain the escape panel in a closed position, the escape panel open position allowing for entry and exit to and from the cage through the floor escape aperture when the cage is out of the non deployed position, the floor having a latching ring for the attachment of an emergency descent rope; and the fighting pod boom elevator aperture having an associated door.

7. An assault vehicle, comprising, in combination:

a vehicle body;

a telescoping vehicle boom being coupled to the vehicle body by a boom mounting bracket, the vehicle boom having a vehicle mounting end and an uppermost extent and the vehicle boom having a passageway there in;

an internal boom elevator having a movable floor, the movable elevator floor being coupled to a rack gear for elevating and lowering the floor of the elevator; and an end unit being coupled to the uppermost extent of the vehicle boom.

8. The assault vehicle as described in claim 7, with the vehicle further comprising:

the vehicle having two pairs of boom control hydraulic cylinders operatively coupled to the boom and the boom mounting bracket for moving the boom within a cone shaped area; and the vehicle boom comprising a hollow tubular structure with an interior and an exterior, the boom also having the internal boom elevator associated therewith, the elevator being housed and contained within the interior of the boom.

9. The assault vehicle as described in claim 8 with the end unit being a fighting pod having a lower portion and an upper portion and a ramming portion.

10. The assault vehicle as described in claim 8, with the vehicle further comprising:

the vehicle boom mounting bracket pivotably mounting the boom to the top surface of the vehicle body at an area of attachment, with the boom elevator being coupled to the boom mounting bracket, with the internal boom elevator comprising an elevator cage hydraulic cylinder with a slidably movable ram, the cage hydraulic cylinder being coupled to the boom mounting bracket, the ram of the cage hydraulic cylinder having an associated end track coupled thereto, the elevator further comprising an elevator cage gear rack coupled to the end track of the hydraulic cylinder with an elevator cage being coupled to the elevator cage gear rack so as to allow the cage to ride up and down the end track of the ram, and a ram guiding sleeve having a mounting plate and a guide.

11. The assault vehicle as described in claim 10, with the elevator further comprising a ram receiving cup having a mounting plate and a cup portion, the pod lower portion having generally rounded configuration with a lowermost extent with the lowermost extent having a location for the coupling of the pod to the boom.

12. The assault vehicle as described in claim 8 with the end unit being a blast shield having explosive detection electronics coupled there to.

13. The assault vehicle as described in claim 8, with the vehicle further comprising the vehicle body having a plurality of associated ground bearing subassemblies, the ground bearing subassemblies having a plurality of associated stabilizing outriggers, each outrigger having a deployed position and a non deployed position, each outrigger having a vehicle attachment end and a surface bearing end.

14. The assault vehicle as described in claim 13 with the elevator cage having a plurality of sides with an overlying mesh, with the cage sides each having a lower extent and an upper extent, with the ram guide sleeve having a top extent with a top internal dimension and external dimension, and a bottom extent with a bottom internal dimension and external dimension, the sleeve guide having a generally C shaped configuration with an outer surface and an inner surface;

the ram receiving cup portion having a generally hemispherical configuration with the cup portion having a downwardly convex external surface and a downwardly concave internal surface; and the fighting pod having a protective skirt associated with the place of joining of the pod to the boom.

15. The assault vehicle as described in claim 7, with the elevator floor having a latched passageway there through, the passageway having an associated lock and a hinge and at least one escape rope attachment.

* * * * *